US006154918A

United States Patent [19]

Cain et al.

[11] Patent Number: 6,154,918

[45] Date of Patent: Dec. 5, 2000

[54] PORTABLE VACUUM CLEANER HANDLE CONSTRUCTION

[76] Inventors: Beatrice Cain; Odaree Cain, both of 4 Thomas Ave., Berlin, N.J. 08009

[21] Appl. No.: 09/245,654

[22] Filed: Feb. 8, 1999

[51] Int. Cl.[7] ..... A47L 9/32

[52] U.S. Cl. ..... 15/327.5; 15/344; 15/410

[58] Field of Search ..... 15/327.5, 344, 15/410, 236.01, 405

[56] References Cited

U.S. PATENT DOCUMENTS

| | | | |
|---|---|---|---|
| 1,423,993 | 7/1922 | Buitrago | 15/344 |
| 1,597,272 | 8/1926 | Finkhousen | 15/344 |
| 2,623,234 | 12/1952 | Brown | 15/410 |
| 4,956,892 | 9/1990 | Fawkes | 15/339 |
| 4,962,561 | 10/1990 | Hamilton | 15/236.01 |
| 5,251,281 | 10/1993 | Fravel, Jr. | 15/405 |
| 5,402,550 | 4/1995 | Lessard | 15/144.2 |
| 5,421,058 | 6/1995 | Zahuranec et al. | 15/413 |
| 5,455,981 | 10/1995 | Wiese | 15/236.01 |
| 5,471,700 | 12/1995 | Pereira | 15/236.01 |
| 5,560,076 | 10/1996 | Leung | 15/339 |
| 5,599,401 | 2/1997 | Brosky et al. | 134/21 |
| 5,774,933 | 7/1998 | Jannicelli, Jr. | 15/405 |
| 5,813,088 | 9/1998 | Wagner et al. | 15/327.5 |

*Primary Examiner*—Theresa T. Snider
*Attorney, Agent, or Firm*—Henderson & Sturm LLP

[57] ABSTRACT

A vacuum cleaner construction 10 designed to be suspended from a user's forearm wherein the construction 10 includes a vacuum motor unit 11 suspended beneath a main body unit 12 comprising a vacuum hose body member 30 having an inboard end 31 provided with at least one curved support arm member 40 dimensioned to be slipped over the user's forearm.

12 Claims, 1 Drawing Sheet

PORTABLE VACUUM CLEANER HANDLE CONSTRUCTION

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of portable vacuum cleaners in general, and in particular to a unique handle construction for portable vacuum cleaners that reduces the user's stress and strain in completing a vacuuming task.

2. Description of Related Art

As can be seen by reference to the following U.S. Pat. Nos. 4,956,892; 5,421,058; 5,599,401; and 5,560,076, the prior art is replete with myriad and diverse hand held and/or cordless vacuum cleaner constructions.

While all of the aforementioned prior art constructions are more than adequate for the basic purpose and function for which they have been specifically designed, they are uniformly deficient with respect to their failure to provide a simple, efficient, and practical handle arrangement for cordless vacuum cleaners that is specifically designed to be ergonomically effective in reducing the stress and strain that are normally exerted on a user's wrist and hands during the vacuuming process.

As most older and/or infirm individuals are all too well aware, while cordless vacuum cleaners are normally a godsend to the majority of people, the weight and balance of most hand held vacuum cleaners requires a considerable amount of strength and dexterity on the part of the user to complete their task.

As a consequence of the foregoing situation, there has existed a longstanding need for a new and improved type of handle design for portable vacuum cleaners that facilitates the use of the portable vacuum cleaner and lessens the normal stress and strain on the user's wrist and arm, and the provision of such a construction is a stated objective of the present invention.

BRIEF SUMMARY OF THE INVENTION

Briefly stated, the handle construction for portable vacuum cleaners that forms the basis of the present invention comprises in general, a motor unit, a main body unit, and a suspension unit which operatively engages and suspends the motor unit and the main body unit from one of the user's forearms.

As will be explained in greater detail further on in the specification, the main body unit comprises a telescoping vacuum hose body member having an inboard end which is contoured to receive the palm and fingers of the user's hand.

In addition, the suspension unit comprises a pair of suspension loop members which are dimensioned to slip over and be suspended from the user's forearm such that the user can manipulate both the motor unit and the main body unit without the need to move their hand relative to their wrist.

This straight arm mounting arrangement allows older, infirm, and arthritic individuals to manipulate the vacuum hose as simply and effortlessly as able bodied individuals having greater strength and dexterity.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
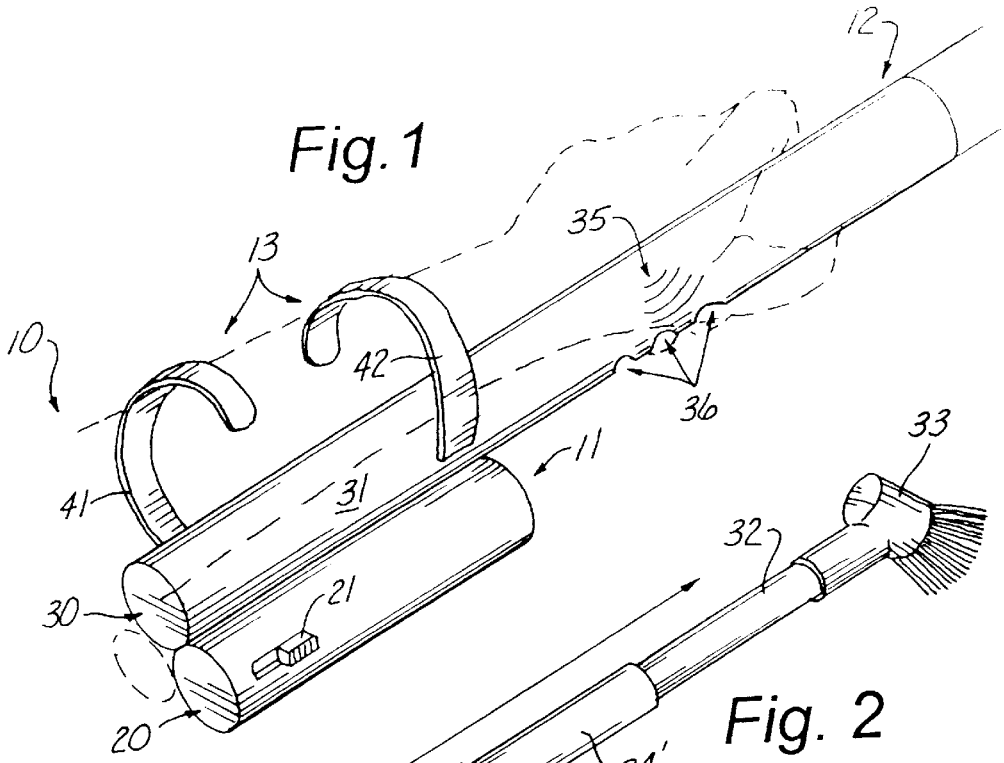
FIG. 1 is an enlarged detail view of the inboard end of the vacuum cleaner construction.

As can be seen by reference to the drawings, and in particularly to FIG. 1, the vacuum cleaner construction that forms the basis of the present invention is designated generally by the reference number 10. The construction 10 comprises in general, a motor unit 11, a main body unit 12, and a suspension unit 13. These units will now be described in seriatim fashion.

Figure 2:
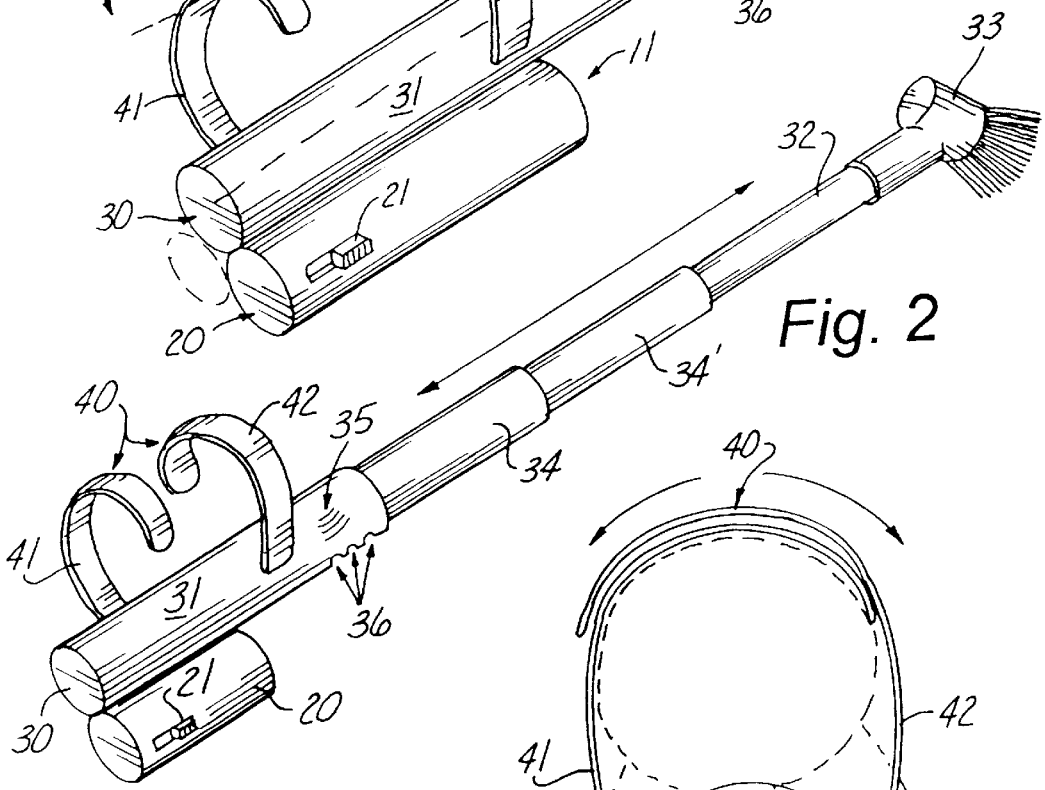
FIG. 2 is a perspective view of the entire vacuum cleaner construction.

As can best be seen by reference to FIGS. 1 and 2, the motor unit 11 comprises a generally cylindrical conventional vacuum motor 20 provided with an on/off switch 21. In addition, the main body unit 12 comprises a telescoping vacuum hose body member 30 having an inboard end 31, an outboard end 32 provided with a vacuum nozzle element 33 and one or more intermediate segments 34, 34'.

As can also be seen by reference to FIGS. 1 and 2, the vacuum motor 20 is suspended from and operatively associated with the inboard end 31 of the telescoping vacuum hose body member 30 in the usual fashion. The vacuum motor will generate a reduced pressure within the vacuum hose body member 30 to collect debris through the vacuum nozzle element 33 in a well recognized fashion.

Still referring to FIGS. 1 and 2, it can be seen that the upper surface of the inboard end 31 of the hose body member 30 is provided with a first recess 35 dimensioned to receive the user's palm. The lower surface of the inboard end of the hose body member 30 is provided with a plurality of finger recesses 36.

Figure 3:
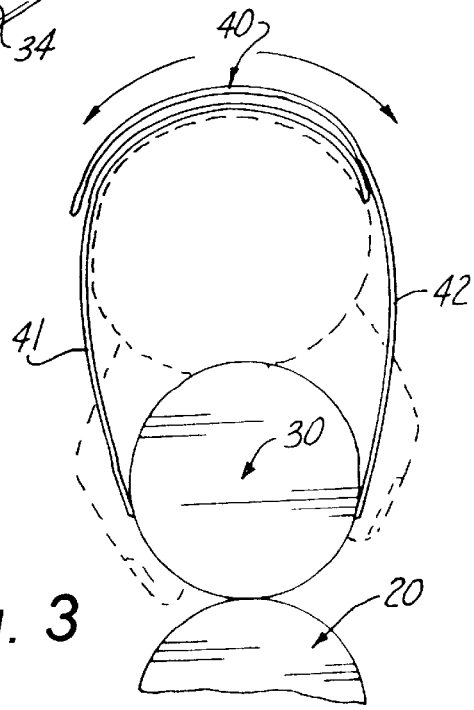
FIG. 3 is an end view of the vacuum cleaner construction.

Turning now to FIGS. 1 through 3, it can be seen that the suspension unit 13 comprises a pair of curved support arm members 40. One of the curved support arm members 41 has a right hand curved end and the other of the curved support arm members 42 is provided with a left hand curved end such that the user can simply and easily slip the support arm members 41, 42 over the opposite sides of the top of their forearm to suspend the remainder of the construction 10 beneath their forearm.

Once the construction 10 is attached to the user's forearm, all of the weight of the construction 10 is applied against the forearm and away from the user's hand and wrist which may still be employed to bear a small portion of the weight load at the user's discretion.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

What is claimed is:

1. A body worn vacuum cleaner construction comprising:

a motor unit including a vacuum motor member;

a main body unit including a vacuum hose body member having an upper surface and a lower surface; wherein the vacuum motor member is operatively connected to the vacuum hose body member; and means associated with the main body unit for suspending the main body unit and the motor unit from one of a user's forearms.

2. The construction as in claim 1 wherein the vacuum motor member is suspended from the lower surface of the vacuum hose body member.

3. The construction as in claim 1 wherein the vacuum hose body member is provided with at least one recess dimensioned to accommodate a portion of the user's hand.

4. The construction as in claim 1 wherein the vacuum hose body member is provided with a plurality of recesses dimensioned to accommodate different portions of the user's hand.

5. The construction as in claim 4 wherein at least some of said plurality of recesses are dimensioned to accommodate some of the user's fingers.

6. The construction as in claim 5 wherein at least one of said plurality of recesses are dimensioned to accommodate a portion of the user's palm.

7. The construction as in claim 1 wherein the vacuum hose body member includes an inboard end and an outboard end provided with a vacuum hose nozzle element.

8. The construction as in claim 7 wherein the outboard end of the vacuum hose body member is telescopically received in the inboard end of the vacuum hose body member.

9. The construction as in claim 7 wherein the inboard end of the vacuum hose body member is provided with said means associated with the main body unit for suspending the main body unit and the motor unit from the user's forearm.

10. The construction as in claim 9 wherein said means comprises:

at least one support arm member operatively connected on one end to the vacuum hose body member; wherein the other end of the at least one support arm member is curved and dimensioned to be slipped over the user's forearm.

11. The construction as in claim 9 wherein said means comprises:

a pair of support arm members operatively connected on one end to the vacuum hose body member wherein the other end of the support arm members are curved and dimensioned to be slipped over the user's forearm.

12. The construction as in claim 11 wherein the curved ends of the support arm members are faced in opposite directions.

* * * * *